US011592036B2

(12) United States Patent
Judge et al.

(10) Patent No.: US 11,592,036 B2
(45) Date of Patent: Feb. 28, 2023

(54) FLUID EXCHANGE DEVICES AND RELATED CONTROLS, SYSTEMS, AND METHODS

(71) Applicant: Flowserve Management Company, Irving, TX (US)

(72) Inventors: Scott Judge, Bethlehem, PA (US); Neil Havrilla, Coplay, PA (US); Nathan Terwilliger, Bethlehem, PA (US); Christopher Shages, Bethlehem, PA (US); A. K. Necioglu, Macungie, PA (US)

(73) Assignee: Flowserve Management Company, Irving, TX (US)

( * ) Notice: Subject to any disclaimer, the term of this patent is extended or adjusted under 35 U.S.C. 154(b) by 182 days.

(21) Appl. No.: 16/678,998

(22) Filed: Nov. 8, 2019

(65) Prior Publication Data

US 2020/0149556 A1 May 14, 2020

Related U.S. Application Data

(60) Provisional application No. 62/758,366, filed on Nov. 9, 2018.

(51) Int. Cl.
*F04F 13/00* (2009.01)
*E21B 34/08* (2006.01)

(52) U.S. Cl.
CPC ..... *F04F 13/00* (2013.01); *E21B 34/08* (2013.01)

(58) Field of Classification Search
CPC ... F04F 13/00; F04F 7/02; E21B 34/08; F04B 53/128; F04B 7/0208
USPC ..... 417/64
See application file for complete search history.

(56) References Cited

U.S. PATENT DOCUMENTS

| | | | |
|---|---|---|---|
| 1,577,242 | A | 3/1926 | Andersen |
| 1,647,189 | A | 11/1927 | Philip et al. |
| 1,647,734 | A | 11/1927 | Kelly |
| 1,769,672 | A | 7/1930 | Blair |
| 2,365,046 | A | 12/1944 | Bottomley |
| 2,600,836 | A | 6/1952 | Boyd |
| 2,615,465 | A | 10/1952 | Woodward |
| 3,089,504 | A | 5/1963 | Crawford |
| 3,223,173 | A | 12/1965 | Paul, Jr. |
| 3,347,554 | A | 10/1967 | Jagger et al. |
| 3,570,510 | A | 3/1971 | Tsutsumi |
| 3,583,606 | A | 6/1971 | Ewald |
| 3,595,265 | A | 7/1971 | Cryder et al. |

(Continued)

FOREIGN PATENT DOCUMENTS

| | | | |
|---|---|---|---|
| CN | 101705930 | B | 2/2012 |
| CN | 102421513 | A | 4/2012 |

(Continued)

OTHER PUBLICATIONS

PCT International Patent Application No. PCT/US2019/060611, International Search Report dated Mar. 19, 2020, 2 pp.

(Continued)

*Primary Examiner* — Woody A Lee, Jr.
*Assistant Examiner* — Justin A Pruitt
(74) *Attorney, Agent, or Firm* — PCFB LLC

(57) ABSTRACT

Pressure exchange devices, systems, and related methods may include a tank, a piston, a valve device, and one or more sensors for monitoring a position of the piston in the tank.

20 Claims, 5 Drawing Sheets

(56) References Cited

U.S. PATENT DOCUMENTS 3,612,361 A 10/1971 Ewald et al.
3,661,167 A 5/1972 Hussey
3,661,400 A 5/1972 Weinand
3,675,825 A 7/1972 Morane
3,675,935 A 7/1972 Ludwig et al.
3,741,243 A 6/1973 Deibler et al.
3,749,291 A 7/1973 Prussin et al.
3,756,273 A 9/1973 Hengesbach
3,776,278 A 12/1973 Allen
4,024,891 A 5/1977 Engel et al.
4,123,332 A 10/1978 Rotter
4,133,346 A 1/1979 Smith et al.
4,134,454 A 1/1979 Taylor
4,176,063 A 11/1979 Tyler
4,234,010 A 11/1980 Jenkins et al.
4,236,547 A 12/1980 Harasewych
4,244,555 A 1/1981 Maggioni et al.
4,308,103 A 12/1981 Rotter
4,321,021 A 3/1982 Pauliukonis
4,350,176 A 9/1982 Lace
4,412,632 A 11/1983 Berger et al.
4,424,917 A 1/1984 Berger et al.
4,479,356 A 10/1984 Gill
4,510,963 A 4/1985 Presley et al.
4,518,006 A 5/1985 Hoffmann et al.
4,570,853 A 2/1986 Schmied
4,579,511 A 4/1986 Burns
4,586,692 A 5/1986 Stephens
4,627,461 A 12/1986 Gordon
4,628,499 A * 12/1986 Hammett ..... F15B 11/048 318/599
4,726,530 A 2/1988 Miller et al.
4,768,542 A 9/1988 Morris
4,834,193 A 5/1989 Leitko et al.
4,999,872 A 3/1991 Jentsch
5,033,557 A 7/1991 Askew
5,070,817 A 12/1991 Momont
5,172,918 A 12/1992 Pecht et al.
5,232,013 A 8/1993 Morris
5,234,031 A 8/1993 Pickett et al.
5,240,036 A 8/1993 Morris
5,299,859 A 4/1994 Tackett et al.
5,300,041 A 4/1994 Haber et al.
5,357,995 A 10/1994 King et al.
5,431,086 A * 7/1995 Morita ..... F15B 15/2807 91/393
5,797,429 A 8/1998 Shumway
5,951,169 A 9/1999 Oklejas et al.
5,992,289 A 11/1999 George et al.
6,036,435 A 3/2000 Oklejas
6,126,418 A 10/2000 Sinnl
6,293,245 B1 9/2001 Bock
RE37,921 E 12/2002 Martin et al.
6,516,897 B2 2/2003 Thompson
6,540,487 B2 4/2003 Polizos et al.
6,607,368 B1 8/2003 Ross et al.
6,647,938 B2 11/2003 Gaessler et al.
6,659,731 B1 12/2003 Hauge
7,021,191 B2 * 4/2006 Moler ..... G05B 19/43 91/393
7,118,349 B2 * 10/2006 Oglesby ..... F04B 15/02 417/430
7,128,084 B2 10/2006 Long et al.
7,201,557 B2 4/2007 Stover
7,306,437 B2 12/2007 Hauge
7,474,013 B2 1/2009 Greenspan et al.
7,670,482 B2 3/2010 Wietham
7,871,522 B2 1/2011 Stover et al.
RE42,432 E 6/2011 Stover
7,997,853 B2 8/2011 Pique et al.
8,075,281 B2 12/2011 Martin et al.
8,297,303 B2 10/2012 Desantis et al.
8,360,250 B2 1/2013 Nguyen et al.
8,465,000 B2 6/2013 Bartell et al.
8,508,168 B2 * 8/2013 Duits ..... F16H 25/2015 318/470
8,579,603 B2 11/2013 Oklejas et al.
8,603,218 B2 12/2013 Montie et al.
8,622,714 B2 1/2014 Andrews
9,108,162 B2 8/2015 Takahashi et al.
9,163,737 B2 10/2015 Andersson
9,328,743 B2 5/2016 Hirosawa et al.
9,435,354 B2 9/2016 Lehner et al.
9,440,895 B2 9/2016 Arluck et al.
9,500,394 B2 11/2016 Manzo
9,523,261 B2 12/2016 Flores et al.
9,546,671 B2 1/2017 Hirosawa et al.
9,556,736 B2 1/2017 Sigurdsson
9,587,752 B2 3/2017 Montague
9,604,889 B2 3/2017 Arluck et al.
9,611,948 B1 4/2017 Andersson
9,683,574 B2 6/2017 Winkler et al.
9,695,795 B2 7/2017 Martin et al.
9,739,128 B2 8/2017 Ghasripoor et al.
9,739,275 B2 8/2017 Robison et al.
9,759,054 B2 9/2017 Gay et al.
9,764,272 B2 9/2017 Martin et al.
9,835,018 B2 12/2017 Krish et al.
9,885,372 B2 2/2018 Arluck et al.
9,920,774 B2 3/2018 Ghasripoor et al.
9,945,210 B2 4/2018 Theodossiou
9,945,216 B2 * 4/2018 Ghasripoor ..... E21B 43/267
9,970,281 B2 5/2018 Ghasripoor et al.
9,975,789 B2 5/2018 Ghasripoor et al.
9,976,573 B2 5/2018 Martin et al.
10,001,030 B2 6/2018 Krish et al.
10,006,524 B2 6/2018 Crump et al.
10,024,496 B2 7/2018 Hauge
10,030,372 B2 7/2018 Di Monte, Sr.
10,072,675 B2 9/2018 McLean et al.
10,119,379 B2 11/2018 Richter et al.
10,125,796 B2 11/2018 Hauge
10,138,907 B2 11/2018 Pinto et al.
10,161,421 B2 * 12/2018 Oklejas, Jr. ..... F04B 53/14
10,167,710 B2 1/2019 Ghasripoor et al.
10,167,712 B2 1/2019 Ghasripoor et al.
10,550,860 B2 * 2/2020 Perkins ..... F15B 15/28
2002/0025264 A1 2/2002 Polizos et al.
2004/0118462 A1 6/2004 Baumann
2005/0103386 A1 5/2005 Magda
2006/0145426 A1 7/2006 Schroeder et al.
2006/0196474 A1 9/2006 Magel
2006/0231577 A1 10/2006 Powling et al.
2007/0204916 A1 9/2007 Clayton et al.
2009/0057084 A1 3/2009 Mahawili
2009/0104046 A1 4/2009 Martin et al.
2009/0313737 A1 12/2009 Richard
2012/0024249 A1 2/2012 Fuhrmann et al.
2012/0067825 A1 3/2012 Pique et al.
2014/0026608 A1 1/2014 Manzo et al.
2014/0048143 A1 2/2014 Lehner et al.
2014/0150421 A1 * 6/2014 Sears ..... F04D 29/10 60/591
2014/0284058 A1 9/2014 Watson et al.
2015/0130142 A1 5/2015 Zheng et al.
2015/0184540 A1 7/2015 Winkler et al.
2015/0292310 A1 10/2015 Ghasripoor et al.
2016/0032691 A1 2/2016 Richter et al.
2016/0032702 A1 2/2016 Gay et al.
2016/0039054 A1 2/2016 Ghasripoor et al.
2016/0062370 A1 3/2016 Gaines-Germain et al.
2016/0101307 A1 4/2016 Montague
2016/0102536 A1 4/2016 Knoeller
2016/0138649 A1 5/2016 Anderson et al.
2016/0146229 A1 5/2016 Martin et al.
2016/0153551 A1 6/2016 Schiele et al.
2016/0160849 A1 6/2016 Gains-Germain et al.
2016/0160881 A1 6/2016 Anderson et al.
2016/0160882 A1 6/2016 Morphew
2016/0160887 A1 6/2016 Anderson
2016/0160888 A1 6/2016 Morphew
2016/0160889 A1 6/2016 Hoffman et al.
2016/0160890 A1 6/2016 Anderson

(56) References Cited

U.S. PATENT DOCUMENTS

| | | | |
|---|---|---|---|
| 2016/0160917 | A1 | 6/2016 | Deshpande |
| 2016/0377096 | A1 | 12/2016 | Lehner et al. |
| 2017/0108131 | A1 | 4/2017 | Andersson |
| 2017/0130743 | A1 | 5/2017 | Anderson |
| 2017/0254474 | A1 | 9/2017 | Sauer |
| 2017/0306986 | A1 | 10/2017 | McLean et al. |
| 2017/0306987 | A1 | 10/2017 | Theodossiou |
| 2017/0350428 | A1 | 12/2017 | Martin et al. |
| 2017/0370500 | A1 | 12/2017 | Haines et al. |
| 2018/0030968 | A1* | 2/2018 | Verma ..... E21B 43/26 |
| 2018/0056211 | A1 | 3/2018 | Seabrook et al. |
| 2018/0087364 | A1 | 3/2018 | Krish et al. |
| 2018/0094648 | A1 | 4/2018 | Hoffman et al. |
| 2018/0120197 | A1 | 5/2018 | Di Monte |
| 2018/0195370 | A1 | 7/2018 | Theodossiou |
| 2018/0209254 | A1 | 7/2018 | Ghasripoor et al. |
| 2018/0252239 | A1 | 9/2018 | Martin et al. |
| 2018/0306672 | A1 | 10/2018 | Pattom et al. |
| 2018/0347601 | A1 | 12/2018 | Hoffman et al. |
| 2019/0071340 | A1 | 3/2019 | Imrie |
| 2020/0149362 | A1 | 5/2020 | Terwilliger et al. |
| 2020/0149380 | A1 | 5/2020 | Procita et al. |
| 2020/0149557 | A1 | 5/2020 | Le Doux, Jr. et al. |
| 2020/0149657 | A1 | 5/2020 | Christian et al. |
| 2020/0150698 | A1 | 5/2020 | Judge et al. |

FOREIGN PATENT DOCUMENTS

| | | | |
|---|---|---|---|
| CN | 206158951 | U | 5/2017 |
| EA | 7861 | B1 | 2/2007 |
| EP | 0163897 | B1 | 7/1988 |
| EP | 1486706 | A1 | 12/2004 |
| EP | 1948942 | B1 | 4/2009 |
| EP | 3177429 | A1 | 6/2017 |
| GB | 0946494 | A | 1/1964 |
| JP | 6386657 | B2 | 9/2018 |
| NZ | 503937 | A | 6/2002 |
| RU | 2149287 | C1 | 5/2000 |
| RU | 2010145595 | A | 5/2012 |
| RU | 2496029 | C2 | 10/2013 |
| RU | 2511638 | C2 | 4/2014 |
| SG | 151056 | A1 | 5/2009 |
| WO | 02/66816 | A1 | 8/2002 |
| WO | 2010/031162 | A9 | 11/2010 |
| WO | 2015025094 | A1 | 2/2015 |
| WO | 2016014141 | A2 | 1/2016 |
| WO | 2016/022706 | A1 | 2/2016 |
| WO | 2016/063194 | A3 | 7/2016 |
| WO | 2017/083500 | A1 | 5/2017 |
| WO | 2018/035201 | A1 | 2/2018 |
| WO | 2018/085740 | A2 | 5/2018 |

OTHER PUBLICATIONS

PCT International Patent Application No. PCT/US2019/060611, Written Opinion dated Mar. 19, 2020, 6 pp.

Vorteq Pure Grit, This changes everything, Brochure, Energy Recovery Inc, 8 pages.

* cited by examiner

FLUID EXCHANGE DEVICES AND RELATED CONTROLS, SYSTEMS, AND METHODS

CROSS-REFERENCE TO RELATED APPLICATION

This application claims the benefit under 35 U.S.C. § 119(e) of U.S. Provisional Patent Application Ser. No. 62/758,366, filed Nov. 9, 2018, for "Fluid Exchange Devices and Related Controls, Systems, and Method," the disclosure of which is hereby incorporated herein in its entirety by this reference.

TECHNICAL FIELD

The present disclosure relates generally to exchange devices. More particularly, embodiments of the present disclosure relate to fluid exchange devices for one or more of exchanging properties (e.g., pressure) between fluids and systems and methods.

BACKGROUND

Industrial processes often involve hydraulic systems including pumps, valves, impellers, etc. Pumps, valves, and impellers may be used to control the flow of the fluids used in the hydraulic processes. For example, some pumps may be used to increase (e.g., boost) the pressure in the hydraulic system, other pumps may be used to move the fluids from one location to another. Some hydraulic systems include valves to control where a fluid flows. Valves may include control valves, ball valves, gate valves, globe valves, check valves, isolation valves, combinations thereof, etc.

Some industrial processes involve the use of caustic fluids, abrasive fluids, and/or acidic fluids. These types of fluids may increase the amount of wear on the components of a hydraulic system. The increased wear may result in increased maintenance and repair costs or require the early replacement of equipment. For example, abrasive, caustic, or acidic fluid may increase the wear on the internal components of a pump such as an impeller, shaft, vanes, nozzles, etc. Some pumps are rebuildable and an operation may choose to rebuild a worn pump replacing the worn parts which may result in extended periods of downtime for the worn pump resulting in either the need for redundant pumps or a drop in productivity. Other operations may replace worn pumps at a larger expense but a reduced amount of downtime.

Well completion operations in the oil and gas industry often involve hydraulic fracturing (often referred to as fracking or fracing) to increase the release of oil and gas in rock formations. Hydraulic fracturing involves pumping a fluid (e.g., frac fluid, fracking fluid, etc.) containing a combination of water, chemicals, and proppant (e.g., sand, ceramics) into a well at high pressures. The high pressures of the fluid increases crack size and crack propagation through the rock formation releasing more oil and gas, while the proppant prevents the cracks from closing once the fluid is depressurized. Fracturing operations use high-pressure pumps to increase the pressure of the fracking fluid. However, the proppant in the fracking fluid increases wear and maintenance on and substantially reduces the operation lifespan of the high-pressure pumps due to its abrasive nature.

BRIEF SUMMARY

Various embodiments may include a device for exchanging pressure between fluids. The device may include at least one tank, at least one piston, a valve device, and at least one sensor. The tank may include a first side (e.g., a clean side) for receiving a first fluid (e.g., clean fluid) at a higher pressure and a second side (e.g., a dirty side) for receiving a second fluid (e.g., downhole fluid, fracking fluid, drilling fluid) at a lower pressure. The piston may be in the tank. The piston may be configured to separate the clean fluid from the downhole fluid. The valve device may be configured to selectively place the clean fluid at the higher pressure in communication with the downhole fluid at the lower pressure through the piston to pressurize the downhole fluid to a second higher pressure. The sensor may be configured to detect a presence of the piston.

Another embodiment may include a device for exchanging at least one property between fluids. The device may include at least one tank, at least one piston, a valve device, and at least one sensor. The tank may include a first end for receiving a clean fluid with a first property and a second end for receiving a dirty fluid with a second property. The piston may be in the tank. The piston may be configured to separate the clean fluid from the dirty fluid. The valve device may be configured to selectively place the clean fluid in communication with the dirty fluid through the piston to transfer the first property of the clean fluid to the dirty fluid. The sensor may be configured to detect a position of the piston.

Another embodiment may include a system for exchanging pressure between at least two fluid streams. The system may include a pressure exchange device as described above, and at least one pump for supplying clean fluid to the pressure exchange device.

Another embodiment may include a method of controlling a pressure exchange device. The method may include supplying a high pressure fluid to a high pressure inlet of a valve configured to direct flow of the high pressure fluid to a chamber. A pressure may be transferred from the high pressure fluid to a dirty fluid through a piston in the chamber. A location of the piston may be monitored. A position of the valve may be changed responsive the location of the piston. Flow of the high pressure fluid may be redirected by the changing of the position of the valve.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
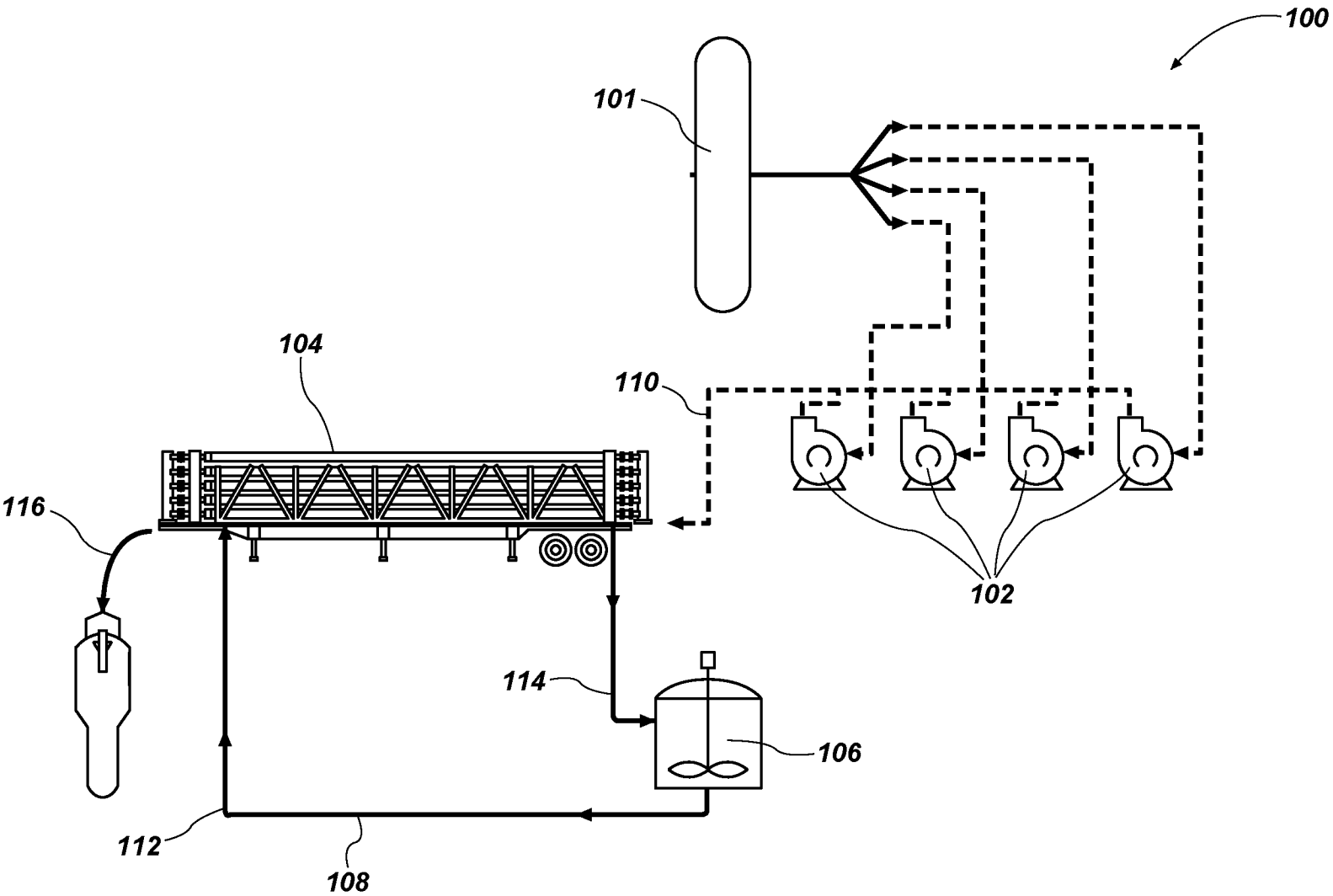
FIG. 1 is schematic view of a hydraulic fracturing system according to an embodiment of the present disclosure.

The illustrations presented herein are not meant to be actual views of any particular fluid exchanger or component thereof, but are merely idealized representations employed to describe illustrative embodiments. The drawings are not necessarily to scale. Elements common between figures may retain the same numerical designation.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical" and "lateral" refer to the orientations as depicted in the figures.

As used herein, the term "substantially" or "about" in reference to a given parameter means and includes to a degree that one skilled in the art would understand that the given parameter, property, or condition is met with a small degree of variance, such as within acceptable manufacturing tolerances. For example, a parameter that is substantially met may be at least 90% met, at least 95% met, at least 99% met, or even 100% met.

As used herein, the term "fluid" may mean and include fluids of any type and composition. Fluids may take a liquid form, a gaseous form, or combinations thereof, and, in some instances, may include some solid material. In some embodiments, fluids may convert between a liquid form and a gaseous form during a cooling or heating process as described herein. In some embodiments, the term fluid includes gases, liquids, and/or pumpable mixtures of liquids and solids.

Embodiments of the present disclosure may relate to exchange devices that may be utilized to exchange one or more properties between fluids (e.g., a pressure exchanger). Such exchangers (e.g., pressure exchangers) are sometimes called "flow-work exchangers" or "isobaric devices" and are machines for exchanging pressure energy from a relatively high-pressure flowing fluid system to a relatively low-pressure flowing fluid system.

In some industrial processes, elevated pressures are required in certain parts of the operation to achieve the desired results, following which the pressurized fluid is depressurized. In other processes, some fluids used in the process are available at high-pressures and others at low-pressures, and it is desirable to exchange pressure energy between these two fluids. As a result, in some applications, great improvement in economy can be realized if pressure can be efficiently transferred between two fluids.

In some embodiments, exchangers as disclosed herein may be similar to and include the various components and configurations of the pressure exchangers disclosed in U.S. Pat. No. 5,797,429 to Shumway, issued Aug. 25, 1998, the disclosure of which is hereby incorporated herein in its entirety by this reference.

Although some embodiments of the present disclosure are depicted as being used and employed as a pressure exchanger between two or more fluids, persons of ordinary skill in the art will understand that the embodiments of the present disclosure may be employed in other implementations such as, for example, the exchange of other properties (e.g., temperature, density, etc.) and/or composition between one or more fluids and/or mixing of two or more fluids.

In some embodiments, a pressure exchanger may be used to protect moving components (e.g., pumps, valves, impellers, etc.) in processes were high pressures are needed in a fluid that has the potential to damage the moving components (e.g., abrasive fluid, caustic fluid, acidic fluid, etc.).

For example, pressure exchange devices according to embodiments of the disclosure may be implemented in hydrocarbon related processes, such as, hydraulic fracturing or other drilling operations (e.g., subterranean downhole drilling operations).

As discussed above, well completion operations in the oil and gas industry often involve hydraulic fracturing, drilling operations, or other downhole operations that use high-pressure pumps to increase the pressure of the downhole fluid (e.g., fluid that is intended to be conducted into a subterranean formation or borehole, such as, fracking fluid, drilling fluid, drilling mud). The proppants, chemicals, additives to produce mud, etc. in these fluids often increase wear and maintenance on the high-pressure pumps.

In some embodiments, a hydraulic fracturing system may include a hydraulic energy transfer system that transfers pressure between a first fluid (e.g., a clean fluid, such as a partially (e.g., majority) or substantially proppant free fluid or a pressure exchange fluid) and a second fluid (e.g., fracking fluid, such as a proppant-laden fluid, an abrasive fluid, or a dirty fluid). Such systems may at least partially (e.g., substantially, primarily, entirely) isolate the high-pressure first fluid from the second dirty fluid while still enabling the pressurizing of the second dirty fluid with the high-pressure first fluid and without having to pass the second dirty fluid directly through a pump or other pressurizing device.

While some embodiments discussed herein may be directed to fracking operations, in additional embodiments, the exchanger systems and devices disclosed herein may be utilized in other operations. For example, devices, systems, and/or method disclosed herein may be used in other downhole operations, such as, for example, downhole drilling operations.

FIG. 1 illustrates a system diagram of an embodiment of hydraulic fracturing system 100 utilizing a pressure exchanger between a first fluid stream (e.g., clean fluid stream) and a second fluid stream (e.g., a fracking fluid stream). Although not explicitly described, it should be understood that each component of the system 100 may be directly connected or coupled via a fluid conduit (e.g., pipe) to an adjacent (e.g., upstream or downstream) component. The hydraulic fracturing system 100 may include one or more devices for pressurizing the first fluid stream, such as, for example, frack pumps 102 (e.g., reciprocating pumps, centrifugal pumps, scroll pumps, etc.). The system 100 may include multiple frack pumps 102, such as at least two frack pumps 102, at least four frack pumps 102, at least ten frack pumps 102, at least sixteen frack pumps, or at least twenty frack pumps 102. In some embodiments, the frack pumps 102 may provide relatively and substantially clean fluid at a high pressure to a pressure exchanger 104 from a fluid source 101. In some embodiments, fluid may be provided separately to each pump 102 (e.g., in a parallel configuration). After pressurization in the pumps 102, the high pressure clean fluid 110 may be combined and transmitted to the pressure exchanger 104 (e.g., in a serial configuration).

As used herein, "clean" fluid may describe fluid that is at least partially or substantially free (e.g., substantially entirely or entirely free) of chemicals and/or proppants typically found in a downhole fluid and "dirty" fluid may describe fluid that at least partially contains chemicals, other additives, and/or proppants typically found in a downhole fluid.

The pressure exchanger 104 may transmit the pressure from the high pressure clean fluid 110 to a low pressure fracking fluid (e.g., fracking fluid 112) in order to provide a high pressure fracking fluid 116. The clean fluid may be expelled from the pressure exchanger 104 as a low pressure fluid 114 after the pressure is transmitted to the low pressure fracking fluid 112. In some embodiments, the low pressure fluid 114 may be an at least partially or substantially clean fluid that substantially lacks chemicals and/or proppants aside from a small amount that may be passed to the low pressure fluid 114 from the fracking fluid 112 in the pressure exchanger 104.

In some embodiments, the pressure exchanger 104 may include one or more pressure exchanger devices (e.g., operating in parallel). In such configurations, the high pressure inputs may be separated and provided to inputs of each of the pressure exchanger devices. The outputs of each of the pressure exchanger devices may be combined as the high pressure fracking fluid exits the pressure exchanger 104. For example, and as discussed below with reference to FIG. 4, the pressure exchanger 104 may include two or more (e.g., three) pressure exchanger devices operating in parallel. As depicted, the pressure exchanger 104 may be provided on a mobile platform (e.g., a truck trailer) that may be relatively easily installed and removed from a fracking well site.

After being expelled from the pressure exchanger 104, the low pressure clean fluid 114 may travel to and be collected in a mixing chamber 106 (e.g., blender unit, mixing unit, etc.). In some embodiments, the low pressure fluid 114 may be converted (e.g., modified, transformed, etc.) to the low pressure fracking fluid 112 in the mixing chamber 106. For example, a proppant may be added to the low pressure clean fluid 114 in the mixing chamber 106 creating a low pressure fracking fluid 112. In some embodiments, the low pressure clean fluid 114 may be expelled as waste.

In many hydraulic fracturing operations, a separate process may be used to heat the fracking fluid 112 before the fracking fluid 112 is discharged downhole (e.g., to ensure proper blending of the proppants in the fracking fluid). In some embodiments, using the low pressure clean fluid 114 to produce the fracking fluid 112 may eliminate the step of heating the fracking fluid. For example, the low pressure clean fluid 114 may be at an already elevated temperature as a result of the fracking pumps 102 pressurizing the high pressure clean fluid 110. After transferring the pressure in the high pressure clean fluid 110 that has been heated by the pumps 102, the now low pressure clean fluid 114 retains at least some of that heat energy as it is passed out of the pressure exchanger 104 to the mixing chamber 106. In some embodiments, using the low pressure clean fluid 114 at an already elevated temperature to produce the fracking fluid may result in the elimination of the heating step for the fracking fluid. In other embodiments, the elevated temperature of the low pressure clean fluid 114 may result in a reduction of the amount of heating required for the fracking fluid.

After the proppant is added to the low pressure fluid 114, now fracking fluid, the low pressure fracking fluid 112 may be expelled from the mixing chamber 106. The low pressure fracking fluid 112 may then enter the pressure exchanger 104 on the fracking fluid end through a fluid conduit 108 connected (e.g., coupled) between the mixing chamber 106 and the pressure exchanger 104. Once in the pressure exchanger 104, the low pressure fracking fluid 112 may be pressurized by the transmission of pressure from the high pressure clean fluid 110 through the pressure exchanger 104. The high pressure fracking fluid 116 may then exit the pressure exchanger 104 and be transmitted downhole.

Hydraulic fracturing systems generally require high operating pressures for the high pressure fracking fluid 116. In some embodiments, the desired pressure for the high pressure fracking fluid 116 may be between about 8,000 PSI (55,158 kPa) and about 12,000 PSI (82,737 kPa), such as between about 9,000 PSI (62,052 kPa) and about 11,000 PSI (75,842 kPa), or about 10,000 PSI (68,947 kPa).

In some embodiments, the high pressure clean fluid 110 may be pressurized to a pressure at least substantially the same or slightly greater than the desired pressure for the high pressure fracking fluid 116. For example, the high pressure clean fluid 110 may be pressurized to between about 0 PSI (0 kPa) and about 1000 PSI (6,894 kPa) greater than the desired pressure for the high pressure fracking fluid 116, such as between about 200 PSI (1,379 kPa) and about 700 PSI (4,826 kPa) greater than the desired pressure, or between about 400 PSI (2,758 kPa) and about 600 PSI (4,137 kPa) greater than the desired pressure, to account for any pressure loss during the pressure and exchange process.

Figure 2:
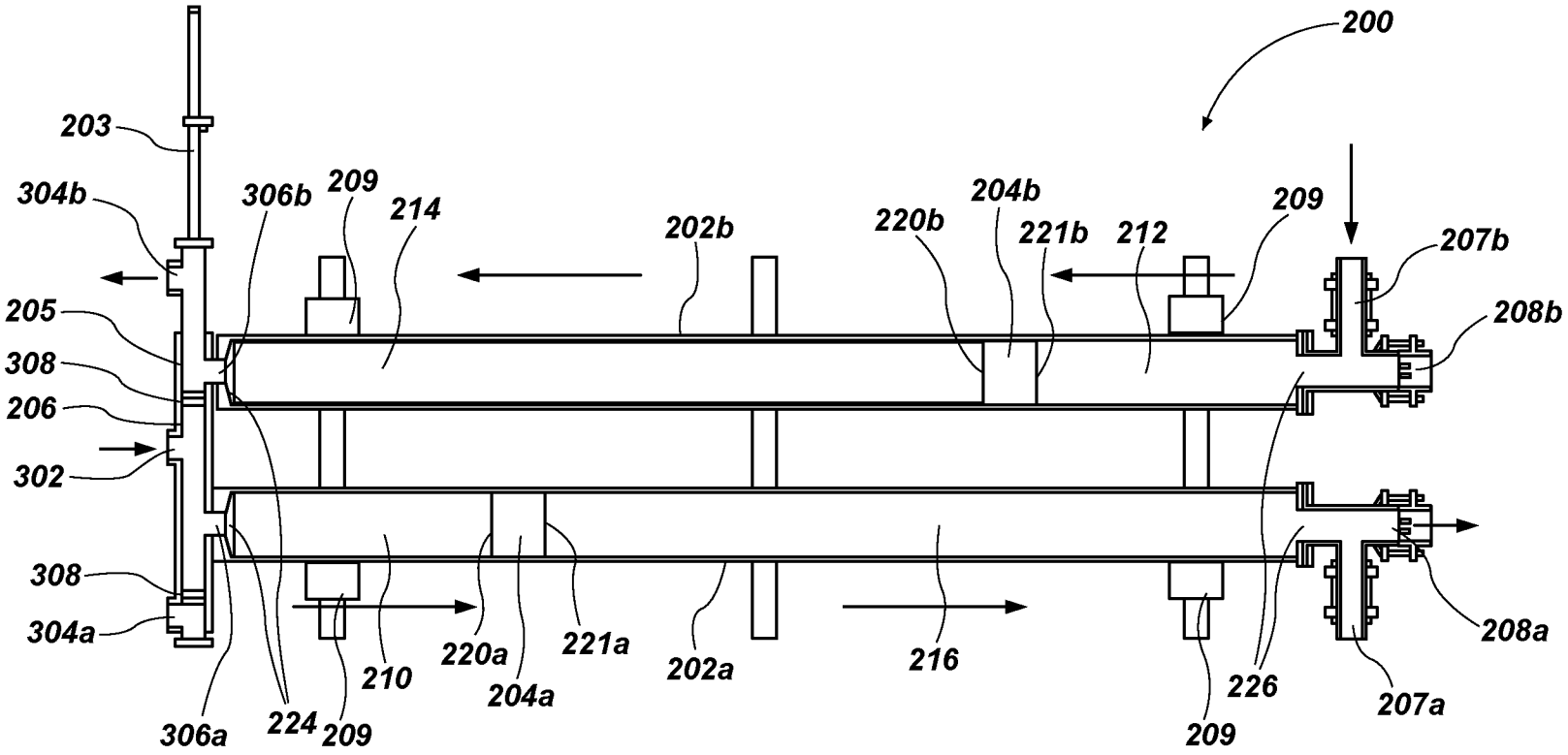
FIG. 2 is cross-sectional view of a fluid exchanger device according to an embodiment of the present disclosure.

FIG. 2 illustrates an embodiment of a pressure exchanger 200. The pressure exchanger 200 may be a linear pressure exchanger in the sense that it is operated by moving or translating an actuation assembly substantially along a linear path. For example, the actuation assembly may be moved linearly to selectively place the low and high pressure fluids in at least partial communication (e.g., indirect communication where the pressure of the high pressure fluid may be transferred to the low pressure fluid) as discussed below in greater detail.

The linear pressure exchanger 200 may include one or more (e.g., two) chambers 202*a*, 202*b* (e.g., tanks, collectors, cylinders, tubes, pipes, etc.). The chambers 202*a*, 202*b* (e.g., parallel chambers 202*a*, 202*b*) may include pistons 204*a*, 204*b* configured to substantially maintain the high pressure clean fluid 210 and low pressure clean fluid 214 (e.g., the clean side) separate from the high pressure dirty fluid 216 and the low pressure dirty fluid 212 (e.g., the dirty side) while enabling transfer of pressure between the respective fluids 210, 212, 214, and 216. The pistons 204*a*, 204*b* may be sized (e.g., the outer diameter of the pistons 204*a*, 204*b* relative to the inner diameter of the chambers 202*a*, 202*b*) to enable the pistons 204*a*, 204*b* to travel through the chamber 202*a*, 202*b* while minimizing fluid flow around the pistons 204*a*, 204*b*.

The linear pressure exchanger 200 may include a clean control valve 206 configured to control the flow of high pressure clean fluid 210 and low pressure clean fluid 214. Each of the chambers 202*a*, 202*b* may include one or more dirty control valves 207*a*, 207*b*, 208*a*, and 208*b* configured to control the flow of the low pressure dirty fluid 212 and the high pressure dirty fluid 216.

While the embodiment of FIG. 2 contemplates a linear pressure exchanger 200, other embodiments, may include other types of pressure exchangers that involve other mechanisms for selectively placing the low and high pressure fluids in at least partial communication (e.g., a rotary actuator such as those disclosed in U.S. Pat. No. 9,435,354, issued Sep. 6, 2016, the disclosure of which is hereby incorporated herein in its entirety by this reference, etc.).

In some embodiments, the clean control valve 206, which includes an actuation stem 203 that moves one or more stoppers 308 along (e.g., linearly along) a body 205 of the valve 206, may selectively allow (e.g., input, place, etc.) high pressure clean fluid 210 provided from a high pressure inlet port 302 to enter a first chamber 202*a* on a clean side 220*a* of the piston 204*a*. The high pressure clean fluid 210 may act on the piston 204*a* moving the piston 204*a* in a direction toward the dirty side 221*a* of the piston 204*a* and compressing the dirty fluid in the first chamber 202*a* to produce the high pressure dirty fluid 216. The high pressure dirty fluid 216 may exit the first chamber 202*a* through the dirty discharge control valve 208*a* (e.g., outlet valve, high pressure outlet). At substantially the same time, the low pressure dirty fluid 212 may be entering the second chamber 202*b* through the dirty fill control valve 207*b* (e.g., inlet valve, low pressure inlet). The low pressure dirty fluid 212 may act on the dirty side 221*b* of the piston 204*b* moving the piston 204*b* in a direction toward the clean side 220*b* of the piston 204*b* in the second chamber 202*b*. The low pressure clean fluid 214 may be discharged (e.g., emptied, expelled, etc.) through the clean control valve 206 as the piston 204*b* moves in a direction toward the clean side 220*b* of the piston 204*b* reducing the space on the clean side 220*b* of the piston 204*b* within the second chamber 202*b*. A cycle of the pressure exchanger is completed once each piston 204*a*, 204*b* moves the substantial length (e.g., the majority of the length) of the respective chamber 202*a*, 202*b* (which "cycle" may be a half cycle with the piston 204*a*, 204*b* moving in one direction along the length of the chamber 202*a*, 202*b* and a full cycle includes the piston 204*a*, 204*b* moving in the one direction along the length of the chamber 202*a*, 202*b* and then moving in the other direction to return to substantially the original position). In some embodiments, only a portion of the length may be utilized (e.g., in reduced capacity situations). Upon the completion of a cycle, the actuation stem 203 of the clean control valve 206 may change positions enabling the high pressure clean fluid 210 to enter the second chamber 202*b*, thereby changing the second chamber 202*b* to a high pressure chamber and changing the first chamber 202*a* to a low pressure chamber and repeating the process.

In some embodiments, each chamber 202*a*, 202*b* may have a higher pressure on one side of the pistons 204*a*, 204*b* to move the piston in a direction away from the higher pressure. For example, the high pressure chamber may experience pressures between about 8,000 PSI (55,158 kPa) and about 13,000 PSI (89,632 kPa) with the highest pressures being in the high pressure clean fluid 210 to move the piston 204*a*, 204*b* away from the high pressure clean fluid 210 compressing and discharging the dirty fluid to produce the high pressure dirty fluid 216. The low pressure chamber 202*a*, 202*b* may experience much lower pressures, relatively, with the relatively higher pressures in the currently low pressure chamber 202*a*, 202*b* still being adequate enough in the low pressure dirty fluid 212 to move the piston 204*a*, 204*b* in a direction away from the low pressure dirty fluid 212 discharging the low pressure clean fluid 214. In some embodiments, the pressure of the low pressure dirty fluid 212 may be between about 100 PSI (689 kPa) and about 700 PSI (4,826 kPa), such as between about 200 PSI (1,379 kPa) and about 500 PSI (3,447 kPa), or between about 300 PSI (2,068 kPa) and about 400 PSI (2758 kPa).

Referring back to FIG. 1, in some embodiments, the system 100 may include an optional device (e.g., a pump) to pressurize the low pressure dirty fluid 212 (e.g., to a pressure level that is suitable to move the piston 204*a*, 204*b* toward the clean side) as it is being provided into the chambers 202*a*, 202*b*.

Referring again to FIG. 2, if any fluid pushes past the piston 204*a*, 204*b* (e.g., leak by, blow by, etc.) it will generally tend to flow from the higher pressure fluid to the lower pressure fluid. The high pressure clean fluid 210 may be maintained at the highest pressure in the system such that the high pressure clean fluid 210 may not generally become substantially contaminated. The low pressure clean fluid 214 may be maintained at the lowest pressure in the system. Therefore, it is possible that the low pressure clean fluid 214 may become contaminated by the low pressure dirty fluid 212. In some embodiments, the low pressure clean fluid 214 may be used to produce the low pressure dirty fluid 212 substantially nullifying any detriment resulting from the contamination. Likewise, any contamination of the high pressure dirty fluid 216 by the high pressure clean fluid 210 would have minimal effect on the high pressure dirty fluid 216.

In some embodiments, the dirty control valves 207*a*, 207*b*, 208*a*, 208*b* may be check valves (e.g., clack valves, non-return valves, reflux valves, retention valves, or one-way valves). For example, one or more of the dirty control valves 207*a*, 207*b*, 208*a*, 208*b* may be a ball check valve, diaphragm check valve, swing check valve, tilting disc check valve, clapper valve, stop-check valve, lift-check valve, in-line check valve, duckbill valve, etc. In additional embodiments, one or more of the dirty control valves 207*a*, 207*b*, 208*a*, 208*b* may be actuated valves (e.g., solenoid valves, pneumatic valves, hydraulic valves, electronic valves, etc.) configured to receive a signal from a controller and open or close responsive the signal.

The dirty control valves 207*a*, 207*b*, 208*a*, 208*b* may be arranged in opposing configurations such that when the chamber 202*a*, 202*b* is in the high pressure configuration the high pressure dirty fluid opens the dirty discharge control valve 208*a*, 208*b* while the pressure in the chamber 202*a*, 202*b* holds the dirty fill control valve 207*a*, 207*b* closed. For example, the dirty discharge control valve 208*a*, 208*b* comprises a check valve that opens in a first direction out of the chamber 202*a*, 202*b*, while the dirty fill control valve 207*a*, 207*b* comprises a check valve that opens in a second, opposing direction into the chamber 202*a*, 202*b*.

The dirty discharge control valves 208*a*, 208*b* may be connected to a downstream element (e.g., a fluid conduit, a separate or common manifold) such that the high pressure in the downstream element holds the dirty discharge valve 208*a*, 208*b* closed in the chamber 202*a*, 202*b* that is in the low pressure configuration. Such a configuration enables the low pressure dirty fluid to open the dirty fill control valve 207*a*, 207*b* and enter the chamber 202*a*, 202*b*.

Figure 3A:
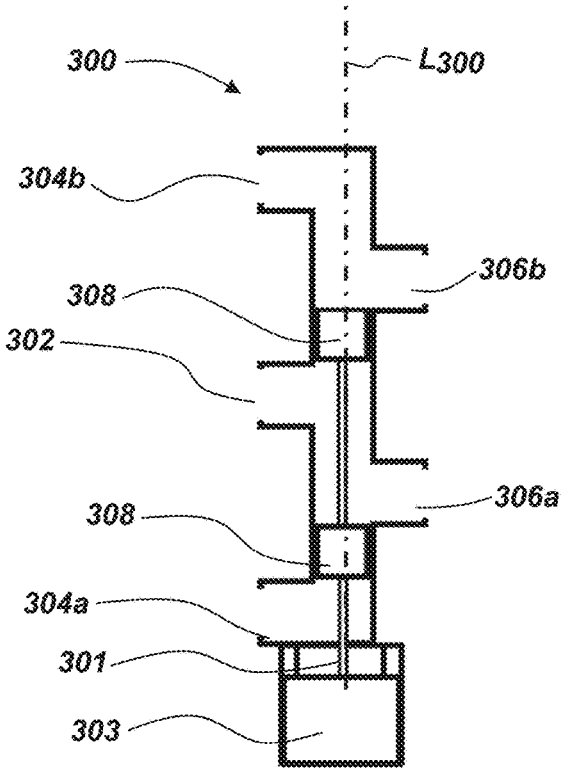
FIG. 3A is a cross-sectional view of a control valve in a first position according to an embodiment of the present disclosure.
Figure 3B:
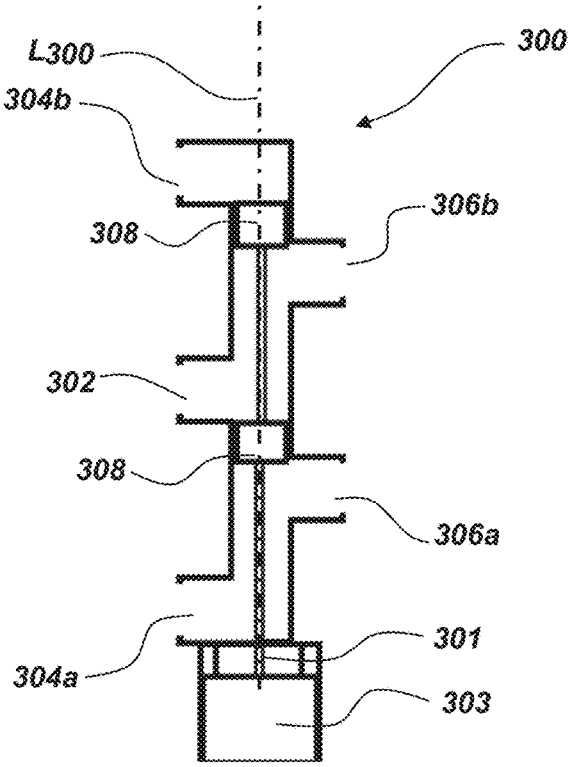
FIG. 3B is a cross-sectional view of a control valve in a second position according to an embodiment of the present disclosure.

FIGS. 3A and 3B illustrate a cross sectional view of an embodiment of a clean control valve 300 at two different positions. In some embodiments, the clean control valve 300 may be similar to the control valve 206 discussed above. The clean control valve 300 may be a multiport valve (e.g., 4 way valve, 5 way valve, LinX® valve, etc.). The clean control valve 300 may have one or more high pressure inlet ports (e.g., one port 302), one or more low pressure outlet ports (e.g., two ports 304*a*, 304*b*), and one or more chamber connection ports (e.g., two ports 306*a*, 306*b*). The clean control valve 300 may include at least two stoppers 308 (e.g., plugs, pistons, discs, valve members, etc.). In some embodiments, the clean control valve 300 may be a linearly actuated valve. For example, the stoppers 308 may be linearly actuated such that the stoppers 308 move along a substantially straight line (e.g., along a longitudinal axis $L_{300}$ of the clean control valve 300).

The clean control valve 300 may include an actuator 303 configured to actuate the clean control valve 300 (e.g., an actuator coupled to a valve stem 301 of the clean control valve 300). In some embodiments, the actuator 303 may be electronic (e.g., solenoid, rack and pinion, ball screw, segmented spindle, moving coil, etc.), pneumatic (e.g., tie rod cylinders, diaphragm actuators, etc.), or hydraulic. In some embodiments, the actuator 303 may enable the clean control valve 300 to move the valve stem 301 and stoppers 308 at variable rates (e.g., changing speeds, adjustable speeds, etc.).

FIG. 3A illustrates the clean control valve 300 in a first position. In the first position, the stoppers 308 may be positioned such that the high pressure clean fluid may enter the clean control valve 300 through the high pressure inlet port 302 and exit into a first chamber through the chamber connection port 306*a*. In the first position, the low pressure clean fluid may travel through the clean control valve 300 between the chamber connection port 306*b* and the low pressure outlet port 304*b* (e.g., may exit through the low pressure outlet port 304*b*).

FIG. 3B illustrates the clean control valve 300 in a second position. In the second position, the stoppers 308 may be positioned such that the high pressure clean fluid may enter the clean control valve 300 through the high pressure inlet port 302 and exit into a second chamber through the chamber connection port 306*b*. The low pressure clean fluid may travel through the clean control valve 300 between the chamber connection port 306*a* and the low pressure outlet port 304*a* (e.g., may exit through the low pressure outlet port 304*a*).

Now referring to FIGS. 2, 3A, and 3B, the clean control valve 206 is illustrated in the first position with the high pressure inlet port 302 connected to the chamber connection port 306*a* providing high pressure clean fluid to the first chamber 202*a*. Upon completion of the cycle, the clean control valve 206 may move the stoppers 308 to the second position thereby connecting the high pressure inlet port 302 to the second chamber 202*b* through the chamber connection port 306*b*.

In some embodiments, the clean control valve 206 may pass through a substantially fully closed position in the middle portion of a stroke between the first position and the second position. For example, in the first position, the stoppers 308 may maintain a fluid pathway between the high pressure inlet port 302 and the chamber connection port 306*a* and a fluid pathway between the chamber connection port 306*b* and the low pressure outlet port 304*b*. In the second position, the stoppers 308 may maintain a fluid pathway between the high pressure inlet port 302 and the chamber connection port 306*b* and a fluid pathway between the chamber connection port 306*a* and the low pressure outlet port 304*a*. Transitioning between the first and second positions may involve at least substantially closing both fluid pathways to change the connection of the chamber connection port 306*a* from the high pressure inlet port 302 to the low pressure outlet port 304*a* and to change the connection of the chamber connection port 306*b* from the low pressure outlet port 304*b* to the high pressure inlet port 302. The fluid pathways may at least substantially close at a middle portion of the stroke to enable the change of connections.

Opening and closing valves, where fluids are operating at high pressures, may result in pressure pulsations (e.g., water hammer) that can result in damage to components in the system when high pressure is suddenly introduced or removed from the system. As a result, pressure pulsations may occur in the middle portion of the stroke when the fluid pathways are closing and opening respectively.

In some embodiments, the actuator 303 may be configured to move the stoppers 308 at variable speeds along the stroke of the clean control valve 206. As the stoppers 308 move from the first position to the second position, the stoppers 308 may move at a high rate of speed while traversing a first portion of the stroke that does not involve newly introducing flow from the high pressure inlet port 302 into the chamber connection ports 306*a*, 306*b*. The stoppers 308 may decelerate to a low rate of speed as the stoppers 308 approach a closed position (e.g., when the stoppers 308 block the chamber connection ports 306*a*, 306*b* during the transition between the high pressure inlet port 302 connection and the low pressure outlet port 304*a*, 304*b* connection) at a middle portion of the stroke. The stoppers 308 may continue at a lower rate of speed, as the high pressure inlet port 302 is placed into communication with one of the chamber connection ports 306*a*, 306*b*. After, traversing the chamber connection ports 306*a*, 306*b*, the stoppers 308 may accelerate to another high rate of speed as the stoppers 308 approach the second position. The low rate of speed in the middle portion of the stroke may reduce the speed that the clean control valve 206 opens and closes enabling the clean control valve to gradually introduce and/or remove the high pressure from the chambers 202*a*, 202*b*.

In some embodiments, the motion of the pistons 204*a*, 204*b* may be controlled by regulating the rate of fluid flow (e.g., of the incoming fluid) and/or a pressure differential between the clean side 220*a*, 220*b* of the pistons 204*a*, 204*b*, and the dirty side 221*a*, 221*b* of the pistons 204*a*, 204*b* at least partially with the movement of the clean control valve 206. In some embodiments, it may be desirable for the piston 204*a*, 204*b* in the low pressure chamber 202*a*, 202*b* to move at substantially the same speed as the piston 204*a*, 204*b* in the high pressure chamber 202*a*, 202*b* either by manipulating their pressure differentials in each chamber and/or by controlling the flow rates of the fluid in and out of the chambers 202*a*, 202*b*. However, the piston 204*a*, 204*b* in the low pressure chamber 202*a*, 202*b* may tend to move at a greater speed than the piston 204*a*, 204*b* in the high pressure chamber 202*a*, 202*b*.

In some embodiments, the rate of fluid flow and/or the pressure differential may be varied to control acceleration and deceleration of the pistons 204*a*, 204*b* (e.g., by manipulating and/or varying the stroke of the clean control valve 206 and/or by manipulating the pressure in the fluid streams with one or more pumps). For example, increasing the flow rate and/or the pressure of the high pressure clean fluid 210 when the piston 204*a*, 204*b* is near a clean end 224 of the chamber 202*a*, 202*b* at the beginning of the high pressure stroke may increase the rate of fluid flow and/or the pressure differential in the chamber 202*a*, 202*b*. Increasing the rate of fluid flow and/or the pressure differential may cause the piston 204*a*, 204*b* to accelerate to or move at a faster rate. In another example, the flow rate and/or the pressure of the high pressure clean fluid 210 may be decreased when the piston 204*a*, 204*b* approaches a dirty end 226 of the chamber 202*a*, 202*b* at the end of the high pressure stroke. Decreasing the rate of fluid flow and/or the pressure differential may cause the piston 204*a*, 204*b* to decelerate and/or stop before reaching the dirty end of the respective chamber 202*a*, 202*b*.

Similar control with the stroke of the clean control valve 206 may be utilized to prevent the piston 204*a*, 204*b* from traveling to the furthest extent of the clean end of the chambers 202*a*, 202*b*. For example, the clean control valve 206 may close off one of the chamber connection ports 306*a*, 306*b* before the piston 204*a*, 204*b* contacts the furthest extent of the clean end of the chambers 202*a*, 202*b* by preventing any further fluid flow and slowing and/or stopping the piston 204*a*, 204*b*. In some embodiments, the clean control valve 206 may open one the chamber connection ports 306*a*, 306*b* into communication with the high pressure inlet port 302 before the piston 204*a*, 204*b* contacts the furthest extent of the clean end of the chambers 202*a*, 202*b* in order to slow, stop, and/or reverse the motion of the piston 204*a*, 204*b*.

If the pistons 204*a*, 204*b* reach the clean end 224 or dirty end 226 of the respective chambers 202*a*, 202*b* the higher pressure fluid may bypass the piston 204*a*, 204*b* and mix with the lower pressure fluid. In some embodiments, mixing the fluids may be desirable. For example, if the pistons 204*a*, 204*b* reach the dirty end 226 of the respective chambers 202*a*, 202*b* during the high pressure stroke, the high pressure clean fluid 210 may bypass the piston 204*a*, 204*b* (e.g., by traveling around the piston 204*a*, 204*b* or through a valve in the piston 204*a*, 204*b*) flushing any residual contaminants from the surfaces of the piston 204*a*, 204*b*. In some embodiments, mixing the fluids may be undesirable. For example, if the pistons 204*a*, 204*b* reach the clean end 224 of the respective chambers 202*a*, 202*b* during the low pressure stroke, the low pressure dirty fluid 212 may bypass the piston 204*a*, 204*b* and mix with the low pressure clean fluid contaminating the clean area in the clean control valve 206 with the dirty fluid.

In some embodiments, the system 100 may prevent the pistons 204*a*, 204*b* from reaching the clean end 224 of the respective chambers 202*a*, 202*b*. For example, the clean control valve 206 may include a control device 209 (e.g., sensor, safety, switch, etc.) to trigger the change in position of the clean control valve 206 on detecting the approach of the piston 204*a*, 204*b* to the clean end 224 of the respective chamber 202*a*, 202*b* such that the system 100 may utilize the clean control valve 206 to change flow path positions before the piston 204*a*, 204*b* reaches the clean end 224 of the chamber 202*a*, 202*b*.

In some embodiments, the system 100 may be configured to enable the pistons 204*a*, 204*b* to reach the dirty end 226 of the respective chambers 202*a*, 202*b* during the high pressure stroke. In some embodiments, the clean control valve 206 may include a control device 209 to trigger the change in position of the clean control valve 206 on detecting the approach of the piston 204*a*, 204*b* to the dirty end 226 of the respective chamber 202*a*, 202*b*. In some embodiments, the control device may be configured such that the control valve 206 does not complete the change in direction of the piston 204*a*, 204*b* until the piston 204*a*, 204*b* has reached the furthest extent of the dirty end 226 of the respective chamber 202*a*, 202*b*. In some embodiments, the control device may include a time delay through programming or mechanical delay that enables the piston 204*a*, 204*b* to reach the furthest extent of the dirty end 226 of the chamber 202*a*, 202*b*.

In some embodiments, the system 100 may be configured to enable the pistons 204*a*, 204*b* to reach the dirty end 226 of the respective chambers 202*a*, 202*b* during the high pressure stroke and prevent the pistons 204*a*, 204*b* from reaching the clean end 224 of the respective chambers 202*a*, 202*b* during the low pressure stroke. For example, the system 100 may drive both of the pistons 204*a*, 204*b* a select distance through the respective chambers 202*a*, 202*b* where the pistons 204*a*, 204*b* is maintained a select distance from the clean end 224 while enabling the pistons 204*a*, 204*b* to travel relatively closer to or come in contact with, the dirty end 226. In some embodiments, the system 100 may be configured such that the rate of fluid flow and/or the pressure differential across the piston 204*a*, 204*b* in the low pressure chamber 202*a*, 202*b* may be less than the rate of fluid flow and/or the pressure differential across the piston 204*a*, 204*b* in the high pressure chamber 202*a*, 202*b* such that the piston 204*a*, 204*b* travels slower during the low pressure cycle than the high pressure cycle.

In some embodiments, the control device 209 may be configured to trigger the change in position of the clean control valve 206 on detecting the approach of the piston 204*a*, 204*b* to the clean end 224 of the respective chamber 202*a*, 202*b* such that the clean control valve 206 may change positions before the piston 204*a*, 204*b* reaches the clean end 224 of the chamber 202*a*, 202*b*. In some embodiments, the control device 209 may be configured to trigger the change in position of the clean control valve 206 on detecting the approach of the piston 204*a*, 204*b* to the dirty end 226 of the respective chamber 202*a*, 202*b*. In some embodiments, the control device may be configured to trigger the change in position of the clean control valve 206 by evaluating both of the pistons 204*a*, 204*b* as they respectively approach the clean end 224 and the dirty end 226 of the chambers 202*a*, 202*b*. For example, the control device 209 may detect the approach of the piston 204*a*, 204*b* to the dirty end 226 of the chamber 202*a*, 202*b* and begin a timer (e.g., mechanical timer, electronic timer, programmed time delay, etc.) If the control device 209 detects the approach of the piston 204*a*, 204*b* to the clean end 224 of the chamber 202*a*, 202*b* before the time triggers the change in position of the clean control valve 206, the control device 209 may override the timer and change the position of the clean control valve 206 to prevent the piston 204*a*, 204*b* from reaching the clean end 224 of the chamber 202*a*, 202*b*.

In some embodiments, an automated controller may produce signals that may be transmitted to the clean control valve 206 directing the clean control valve 206 to move from the first position to the second position or from the second position to the first position (e.g., at a constant and/or variable rate).

FIGS. 4A through 4D illustrate an embodiment of a portion of a pressure exchanger including a control system 400 for the portion of the pressure exchanger. The control system 400 may include a chamber 402, a piston 404, one or more sensors, for example, a first sensor 406 (e.g., a sensor or a portion or element of a sensor assembly, etc.) and a second sensor 408 (e.g., a sensor or a portion or element of a sensor assembly, etc.). In some embodiments, the first sensor 406 and the second sensor 408 may be configured to detect the presence of the piston 404 through a contactless sensor (e.g., magnetic sensor, optical sensor, inductive proximity sensors, Hall Effect sensor, ultrasonic sensor, capacitive proximity sensors, etc.).

In some embodiments, the one or more sensors 406, 408 may each include a sensor or part of a sensor on multiple components (e.g., a moving component, such as the piston 404, and a stationary component, such as on a component positioned proximate or on the chamber 402). In additional embodiments, the control system 400 may include only one sensor may be positioned on a movable or stationary component (e.g., at each location where a location of the piston 404 is to be determined). For example, the sensor may be positioned on the movable piston 404 or on a stationary component (e.g., proximate or on the chamber 402) and may be capable detecting a position of the piston 404 (e.g., by sensing a property of a corresponding movable or stationary component). By way of further example, a sensor proximate or on the chamber 402 may detect the passing of the piston 404 based on a characteristic or property of the piston 404 (e.g., detecting a material of the piston 404, sound of the piston 404, flow characteristics of the piston 404, a marker on the piston 404, etc.). A reverse configuration may also be implemented.

In additional embodiments, the control system 400 may include multiple sensors or only one sensor (e.g., for each chamber 402 or piston).

In additional embodiments, the first sensor 406 and the second sensor 408 may detect the presence of the piston 404 with a sensor requiring direct contact (e.g., contact, button, switch, etc.). In some embodiments, one or more of the first sensor 406 and the second sensor 408 may be a combination sensor including additional sensors, for example, temperature sensors, pressure sensors, strain sensors, conductivity sensors, etc.

Figure 4A:
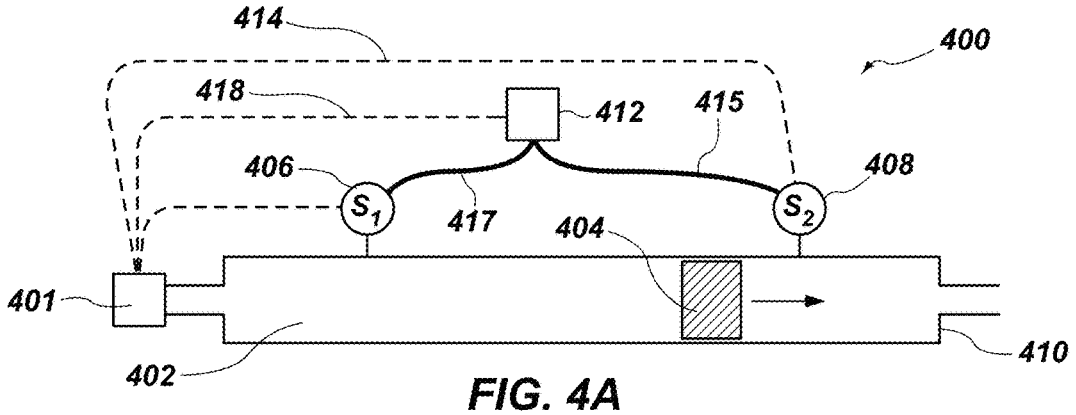
FIG. 4A is a cross-sectional view of a chamber in a first position according to an embodiment of the present disclosure.
Figure 4B:
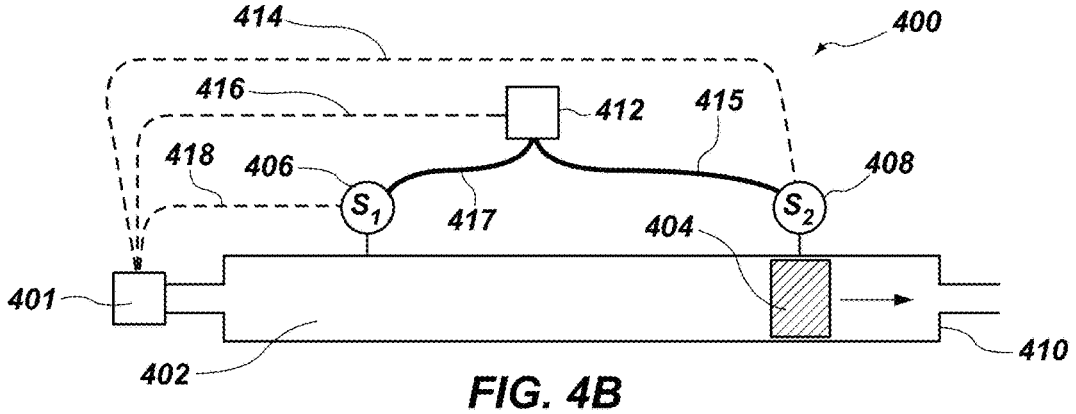
FIG. 4B is a cross-sectional view of a chamber in a second position according to an embodiment of the present disclosure.
Figure 4C:
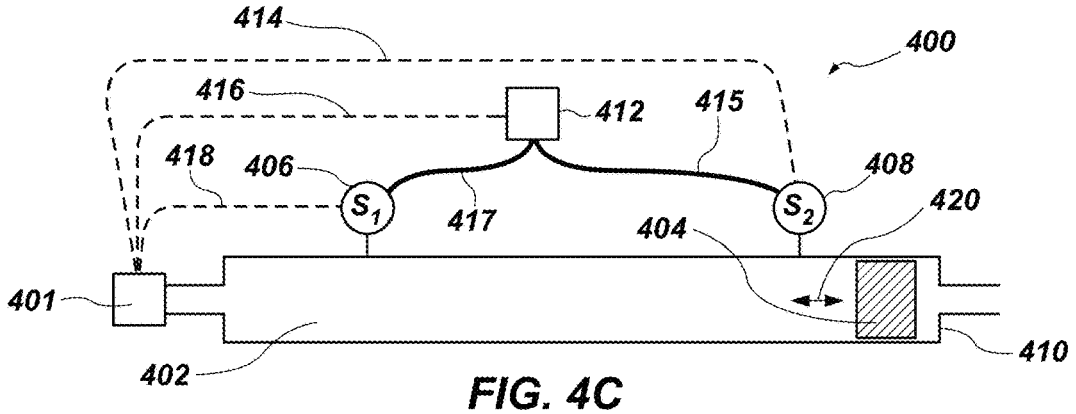
FIG. 4C is a cross-sectional view of a chamber in a third position according to an embodiment of the present disclosure.
Figure 4D:
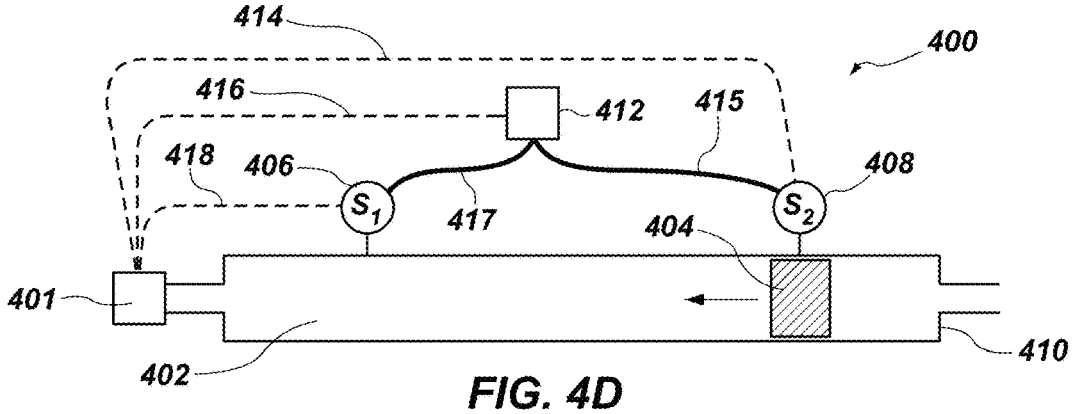
FIG. 4D is a cross-sectional view of a chamber in a fourth position according to an embodiment of the present disclosure.
Figure 5:
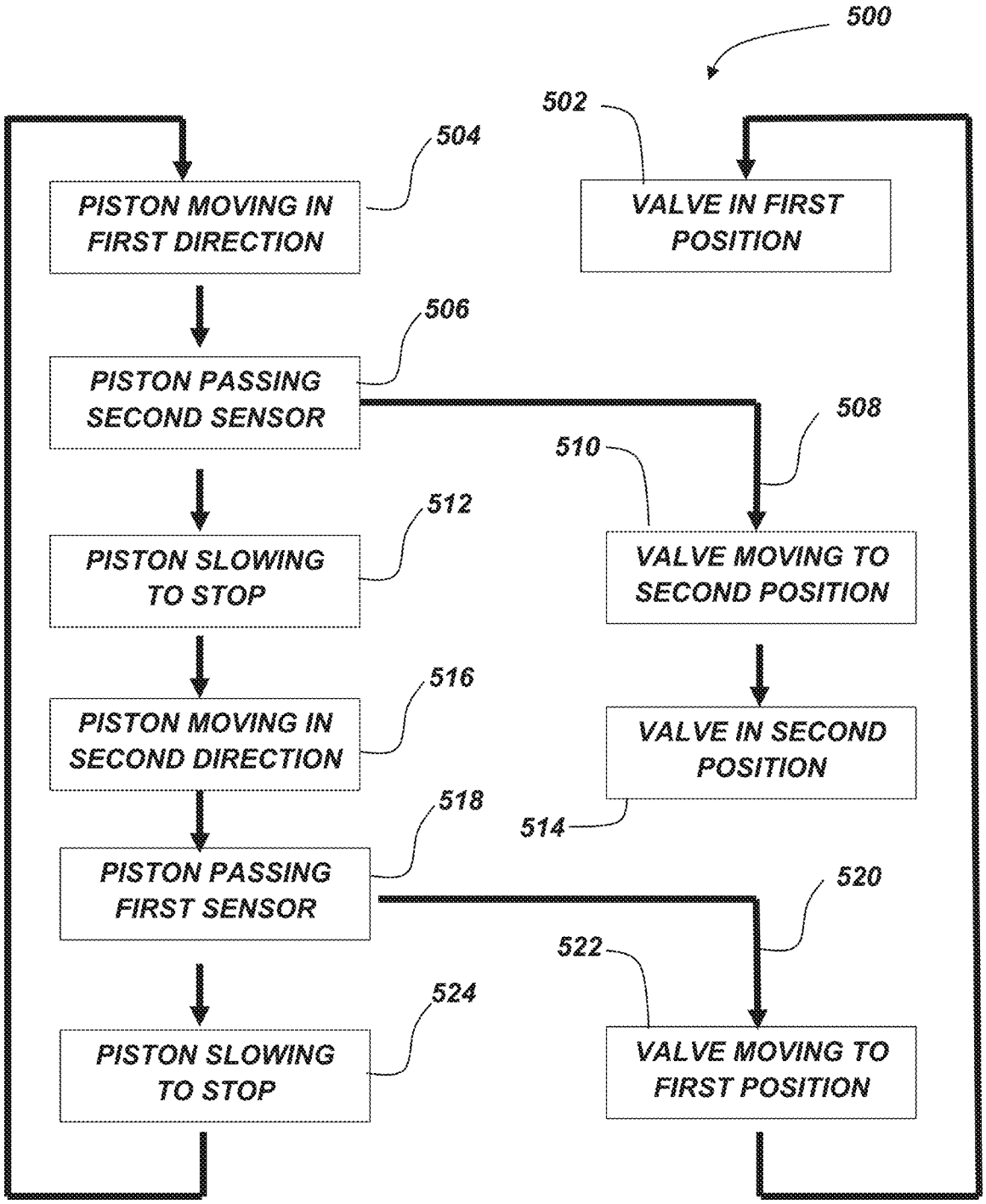
FIG. 5 is a flow diagram of a control process for an embodiment of a fluid exchanger according to the present disclosure.

FIG. 5 illustrates a flow diagram of the control process 500 illustrated in FIGS. 4A through 4D. In FIG. 4A, a control valve 401 (e.g., control valve 206 (FIG. 2)) may be in a first position, see act 502. When the control valve 401 is in the first position, the piston 404 may be moving in a first direction as indicated in act 504. The piston 404 may be moving substantially at the maximum velocity of the piston 404 as the piston approaches the second sensor 408.

In some embodiments, maximum speed of the piston 404 may be between about 2 ft/s (0.609 m/s) and about 50 ft/s (15.24 m/s), such as between about 20 ft/s (6.096 m/s) and about 30 ft/s (9.144 m/s), or between about 25 ft/s (7.62 m/s) and about 35 ft/s (10.668 m/s).

In FIG. 4B, the control valve 401 may remain in the first position. The piston 404 may trigger the second sensor 408 (e.g., close a contact, induce a current, produce a voltage, etc.) by passing by (e.g., through, in front of, or contacting) the second sensor 408 as shown in act 506. The presence of the piston 404 may be transmitted to the control valve 401 as shown in act 508. In some embodiments, the trigger may be transmitted directly to the control valve 401 as a voltage, contact closure, or current as shown by line 414. In some embodiments, the trigger may be interpreted by a controller 412 (e.g., master controller, computer, monitoring system, logging system, etc.). The controller 412 may be in parallel with the control valve 401 (e.g., the trigger is sent to both the controller and the clean control valve 206 (FIG. 2) on separate lines 414, 415 from the second sensor 408) or the controller 412 and the control valve 401 may be in series (e.g., the trigger may pass through the controller before reaching the control valve 401 on a common line 415, 416 or the trigger may pass through the control valve 401 before reaching the controller on the common line). In some embodiments, the controller 412 may relay the trigger to the control valve 401 as a voltage, contact closure, or current. In some embodiments, the control valve 401 may include circuitry (e.g., control board, computer, microcontroller, etc.) capable of receiving and translating the trigger from the second sensor 408. In some embodiments, the controller 412 may interpret the trigger and provide a separate control signal to the control valve 401 responsive the trigger.

The control valve 401 may move to the second position responsive the trigger and/or control signal as shown in act 510. As the control valve 401 moves to the second position, the piston 404 may slow to a stop after having passed the second sensor 408 as shown in FIG. 4C and act 512. In some embodiments, the control valve 401 may change from the first position to the second position in a time period. In some embodiments, the time period may be less than 5 seconds, less than 3 seconds, such as about 2.5 seconds, or less than 1 second, such as less than about 0.5 seconds, or less than about 0.1 seconds. During the time required for the control valve 401 to change positions, the piston 404 may slow from the maximum speed to a speed of zero and travel a distance 420 (FIG. 4B) while decelerating. The distance 420 may be between about 0.5 ft (0.1524 m) or less and about 12 ft (3.6576 m) or between about 0.1 ft (0.03048 m) or less and about 2 ft (6.096 m). The distance 420 may be determined by one or more of several factors including, for example, the processing time of the controller and/or control valve 401, the time required for the control valve 401 to change positions, the maximum speed of the piston 404, a weight of the piston 404, the compressibility of the fluid in the chamber 402, the weight of the piston 404, the flow rate in the chamber 402, etc.

In some embodiments, the position of the second sensor 408 may be determined by considering the distance required for the piston 404 to decelerate to a stop such that the position of the second sensor 408 defines a distance sufficient that the piston 404 will not contact an end wall 410 of the chamber 402. In some embodiments, the position of the second sensor 408 may be determined such that the piston 404 may contact the end wall 410 of the chamber 402 and allow mixing of the fluid from the high pressure side of the piston 404 to the fluid on the low pressure side of the piston 404. In some embodiments, the distance required for the piston 404 to decelerate may be calculated based on estimates for one or more of the factors outlined above. In some embodiments, the distance required for the piston 404 to decelerate may be determined based on experimentation (e.g., lab experiments, data logging, trial and error, etc.). In some embodiments, the position of the second sensor 408 may be adjustable such that the position of the second sensor 408 may be adjusted in the field to account for changing conditions. For example, the second sensor 408 may be mounted to externally on the chamber 402 using a movable fitting, such as a clamped fitting (e.g., band clamp, ear clamp, spring clamp, etc.) or a slotted fitting.

In some embodiments, the trigger may control actions of other related parts of the pressure exchanger system. For example, in some embodiments, the trigger may release a check valve in the piston 404 allowing the high pressure clean fluid 210 (FIG. 2) to flush the dirty side 221*a, b* (FIG. 2) of the piston 404.

In FIG. 4D the control valve 401 may be in the second position as shown in act 514. The piston 404 may begin to accelerate in a second direction as shown in act 516. In some embodiments, the piston 404 may accelerate to the same maximum speed that the piston 404 was previously traveling in the first direction. The piston 404 may continue to travel at the maximum speed until the piston passes the first sensor 406. When the piston 404 passes the first sensor 406, the piston 404 may trigger the first sensor 406 as shown in act 518. In some embodiments, the first sensor 406 may be the same type of sensor as the second sensor 408. In some embodiments, the first sensor 406 may be a different type of sensors from the second sensor 408. In some embodiments, the first sensor 406 may transmit the trigger to the control valve 401 as shown in act 520.

In some embodiments, the trigger may be transmitted directly to the control valve 401, as outlined above with respect to the second sensor 408, on a line 418. In some embodiments, the controller 412 may receive the trigger on line 417 and interpret the trigger and/or transmit the trigger and/or a control signal to the control valve 401, as described above with respect to the second sensor 408. Upon receipt of the control signal or trigger the control valve 401 may begin moving back to the first position as shown in act 522. The piston 404 may again decelerate to a stop as the control valve 401 moves from the second position to the first position as shown in act 524. Once the control valve 401 is in the first position a new cycle may begin starting at act 502.

Now referring to FIGS. 2, 4A through 4D, and 5. In some embodiments, the clean control valve 206 may control movement of one or more pistons 404 one or more respective chambers (e.g., two chambers 202*a*, 202*b*). In some embodiments, one chamber 202*a*, 202*b* may be configured to be the master chamber. For example, the master chamber may include the first sensor 406 and the second sensor 408 and control the motion of the clean control valve 206. In some embodiments, each of the chambers 202*a*, 202*b* may include a first sensor 406 and a second sensor 408, for example, where the sensors 406, 408 in each chamber 202*a*, 202*b* are utilized for differing or the same functions.

In some embodiments, the status of each of the first sensors 406 and the second sensors 408 in each of the chambers 202*a*, 202*b* may be monitored by a controller (e.g., controller 412). The controller 412 may control the clean control valve 206. In some embodiments, the controller 412 may be configured to interpret the signals from some of the sensors 406, 408 to make control determinations (e.g., to instruct a velocity or direction change) for the clean control valve 206 and from other sensors 406, 408 to create records (e.g., logs, models, reports, etc.) of piston 204*a*, 204*b* locations.

In some embodiments, the controller 412 may be configured to change the position of the clean control valve 206 after both a first sensor 406 and a second sensor 408 in opposite chambers 202*a*, 202*b* trigger. In some embodiments, the controller 412 may be configured to change the position of the clean control valve 206 as soon as any of the active first sensors 406 or second sensors 408 trigger in either of the chambers 202*a*, 202*b*.

In some embodiments, duration of each cycle may correlate to the production of the system 100. For example, in each cycle, the pressure exchanger 200 may move a specific amount of dirty fluid defined by the combined capacity of the chambers 202*a*, 202*b*. In some embodiments, the pressure exchanger 200 may move between about 40 gallons (75.7 liters) and about 90 gallons (340.7 liters), such as between about 60 gallons (227.1 liters) and about 80 gallons (302.8 liters), or between about 65 gallons (246.1 liters) and about 75 gallons (283.9 liters). For example, in a system with one or more tanks (e.g., two tanks), each tank in the pressure exchanger 200 may move between about 40 gallons (75.7 liters) and about 90 gallons (340.7 liters) (e.g., two about 60 gallon (227.1 liters) tanks that move about 120 gallons (454.2 liters) per cycle).

In some embodiments, the duration of the cycles may be controlled by varying the rate of fluid flow and/or the pressure differential across the pistons 204*a*, 204*b* with the clean control valve 206. For example, the flow rate and/or pressure of the high pressure clean fluid 210 may be controlled such that the cycles correspond to a desired flow rate of the dirty fluid 212. In some embodiments, the flow rate and/or the pressure may be controlled by controlling a speed of the frack pumps 102 (FIG. 1) (e.g., through a variable frequency drive (VFD), throttle control, etc.), through a mechanical pressure control (e.g., variable vanes, pressure relief system, bleed valve, etc.), or by changing the position of the clean control valve 206 to restrict flow into or out of the chambers 202*a*, 202*b*. For example, the controller 412 may vary the control signal to the clean control valve 206 to maintain a desired pressure.

In some embodiments, maximum production may be the desired condition which may use the shortest possible duration of the cycle. In some embodiments, the shortest duration of the cycle may be defined by the speed of the actuator 303 on the clean control valve 206, 300. In some embodiments, the shortest duration of the cycle may be defined by the maximum pressure of the high pressure clean fluid 210. In some embodiments, the shortest duration may be defined by the response time of the clean control valve 206, 300.

Now referring back to FIGS. 1 and 2. In some embodiments, the pressure exchanger 104 may be formed from multiple linear pressure exchangers 200 operating in parallel. For example the pressure exchanger 104 may be formed from at least 3 linear pressure exchangers, such as at least 5 linear pressure exchangers, or at least 7 linear pressure exchangers. In some embodiments, the pressure exchanger 104 may be modular such that the number of linear pressure exchangers 200 may be changed by adding or removing sections of linear pressure exchangers based on flow requirements. In some embodiments, an operation may include multiple systems operating in an area and the pressure exchangers 104 for each respective system 100 may be adjusted as needed by adding or removing linear pressure exchangers from other systems in the same area.

Pressure exchangers may reduce the amount of wear experienced by high pressure pumps, turbines, and valves in systems with abrasive, caustic, or acidic fluids. The reduced wear may allow the systems to operate for longer periods with less down time resulting in increased revenue or productivity for the systems. Additionally, the repair costs may be reduced as fewer parts may wear out. In operations such as fracking operations, where abrasive fluids are used at high temperatures, repairs and downtime can result in millions of dollars of losses in a single operation. Embodiments of the present disclosure may result in a reduction in wear experienced by the components of systems where abrasive, caustic, or acidic fluids are used at high temperatures. The reduction in wear will result in cost reduction and increased revenue production.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated by the inventors.

What is claimed is:

1. A device for exchanging pressure between fluids, the device comprising:

at least two tanks, each tank of the at least two tanks comprising:

a first side for receiving a first fluid at a higher pressure; and a second side for receiving a second fluid at a lower pressure;

a piston independently disposed in each tank of the at least two tanks and configured to travel unconstrained within the respective tank from a first axial end to a second axial end of the tank, the piston configured to separate the first fluid from the second fluid;

a valve device coupled to each of the at least two tanks at the first axial end of the respective tank, the valve device configured to selectively place the first fluid at the higher pressure in communication with the second fluid at the lower pressure through the piston in order to pressurize the second fluid to a second higher pressure in each of the at least two tanks;

at least two contactless sensors coupled to each of the at least two tanks, the at least two sensors on each of the at least two tanks configured to detect a presence of the piston, a first sensor of the at least two sensors being positioned proximate the first axial end of the tank and a second sensor of the at least two sensors being positioned proximate the second axial end of the tank, the first sensor being axially spaced from the first axial end of the tank to define a first volume in which the piston is configured to travel at the first axial end of the tank between the first sensor and the first axial end, the second sensor being axially spaced from the second axial end of the tank to define a second volume in which the piston is configured to travel at the second axial end of the tank between the second sensor and the second axial end, each of the at least two tanks lacking a sensor at one or more of the first axial end or the second axial end; and a controller configured to receive a signal from the at least two sensors on each of the at least two tanks, the controller configurated to:

when the second sensor detects the piston, and after a preselected time delay, instruct the valve device to reduce flow of the first fluid at the higher pressure at the first axial end of the tank in order to slow and stop movement of the piston in the tank as the piston approaches the second axial end, wherein the selected distance that the second sensor is axially spaced from the second axial end of the tank is selected to enable the controller to contact the second axial end of the tank with the piston and allow mixing of the first fluid at the higher pressure to the second fluid at the lower pressure; and when the first sensor detects the piston, instruct the valve device to increase flow of the first fluid at the higher pressure at the first axial end of the tank in order to slow and stop movement of the piston in the tank as the piston approaches the first axial end in order to prevent the piston contacting the first axial end.

2. The device of claim 1, wherein each of the at least two tanks further comprises:

at least one high pressure outlet for outputting the second fluid at the second higher pressure from the tank; and at least one low pressure outlet for removing the first fluid at a second lower pressure from the tank.

3. The device of claim 1, wherein the valve device is configured to selectively output the first fluid at a second lower pressure from the tank through at least one low pressure outlet.

4. The device of claim 1, wherein the piston and the tank are configured such that the first fluid travels around the piston.

5. The device of claim 1, wherein the valve device is configured to change, after the time delay, from a first position to a second position responsive to the presence of the piston detected by at least one sensor of the at least two sensors.

6. The device of claim 1, wherein each tank of the at least two tanks and the respective piston are configured to remain in communication with the second fluid at the lower pressure at the second side throughout a stroke of the piston.

7. The device of claim 6, wherein the controller is configured to:

receive the presence of the piston from at least one sensor of the at least two sensors; and transmit a control signal to the valve device responsive the presence of the piston after the time delay.

8. The device of claim 1, wherein the valve device is configured to only selectively place each of the at least two tanks and the respective piston in communication with the first fluid at the higher pressure at the first side of the tank.

9. The device of claim 8, wherein each of the at least two tanks are configured to remain in communication with the second fluid at the lower pressure at the second side throughout a stroke of the respective piston.

10. The device of claim 1, wherein the controller is configured to trigger a feature in the piston the enables the first fluid at the higher pressure to travel through the piston.

11. The device of claim 1, wherein the first side of the tank is configured to receive the first fluid comprising a clean fluid and the second side of the tank is configured to receive the second fluid comprising a dirty fluid.

12. A system for exchanging pressure between at least two fluid streams, the system comprising:

a pressure exchange device for exchanging at least one property between fluids, the pressure exchange device comprising:

at least one tank comprising:

a first end for receiving a clean fluid with a first property; and a second end for receiving a dirty fluid with a second property;

at least one piston in the at least one tank, the at least one piston configured to separate the clean fluid from the dirty fluid;

a valve device configured to selectively place the clean fluid in communication with the dirty fluid through the at least one piston in order to at least partially transfer the first property of the clean fluid to the dirty fluid, wherein the at least one tank is coupled to and in fluid communication with the valve device at the first end of the at least one tank; and at least one sensor positioned proximate an axial end of the at least one tank and configured to detect a position of the at least one piston as the at least one piston passes and travels beyond the at least one sensor along a length of the at least one tank in a direction traveling toward the axial end, the at least one tank lacking a sensor at the first axial end or the second axial end.

13. The system of claim 12, further comprising at least two sensors configured to detect a presence of the at least one piston, wherein a first sensor is located near the first end of the at least one tank and a second sensor is located near the second end of the at least one tank.

14. The system of claim 13, wherein the at least two sensors are configured to each transmit a signal to the valve device responsive the position of the at least one piston and the valve device is configured to change from a first position to a second position responsive the signal from the first sensor and change from the second position to the first position responsive the signal from the second sensor.

15. The system of claim 14, wherein the first sensor is located a distance from the first end of the at least one tank, and wherein the distance is sufficient for the at least one piston to change directions responsive to the valve device changing from the first position to the second position before reaching the first end of the tank.

16. The system of claim 14, wherein the at least one tank and the at least one piston comprise at least two tanks, each having a respective piston positioned within a respective tank, wherein each of the at least two tanks is in fluid communication with the valve device, and wherein only one tank of the at least two tanks includes the first sensor and the second sensor, while the other of the at least two tanks lacks such sensors.

17. A method of controlling a pressure exchange device comprising:

supplying a high pressure fluid to a high pressure inlet of a single valve configured to direct flow of the high pressure fluid to a chamber, the single valve being positioned on only one axial end of the chamber;

transferring a pressure from the high pressure fluid to a dirty fluid through a piston in the chamber;

monitoring a location of the piston with at least one sensor positioned proximate the axial end of the chamber as the piston passes and travels beyond the at least one sensor along an axial length of the chamber traveling in a direction toward the axial end;

when the at least one sensor detects the piston, changing a position of the single valve responsive the location of the piston by reducing flow of the high pressure fluid to the chamber with the single valve in order to slow and stop movement of the piston in the chamber as the piston approaches the axial end and before the piston in the chamber contacts the axial end;

while changing the position of the single valve, maintaining fluid communication of a low pressure fluid with the chamber proximate at a second axial end of the chamber;

redirecting the flow of the high pressure fluid by the changing of the position of the single valve;

reversing a direction of travel of the piston by redirecting the flow of the high pressure fluid;

contacting the second axial end of the chamber with the piston and allowing mixing of the high pressure fluid and the low pressure fluid.

18. The method of claim 17, wherein monitoring the location of the piston comprises sensing of a position of the piston within the chamber with the at least one sensor.

19. The method of claim 17, further comprising only sensing the piston at a location spaced from the axial end of the chamber or the second axial end of the chamber.

20. The method of claim 19, further comprising not sensing the piston at the axial end of the chamber and the second axial end of the chamber.

* * * * *